United States Patent [19]

Eskridge et al.

[11] 4,424,184

[45] Jan. 3, 1984

[54] ACCELERATION OF YARN HEAT-STRENGTHENING PROCESS

[75] Inventors: Clifford H. Eskridge, Newark; Robert R. Luise, Wilmington, both of Del.

[73] Assignee: E. I. Du Pont de Nemours & Co., Wilmington, Del.

[21] Appl. No.: 433,785

[22] Filed: Oct. 12, 1982

[51] Int. Cl.[3] ..... B29C 25/00

[52] U.S. Cl. ..... 264/235; 264/346

[58] Field of Search ..... 264/210.3, 235, 346; 8/115.5

[56] References Cited

U.S. PATENT DOCUMENTS

| | | | |
|---|---|---|---|
| 3,975,487 | 8/1976 | Cottis et al. | 264/210 F |
| 4,069,159 | 1/1978 | Hayek | 8/115.5 |
| 4,118,372 | 10/1978 | Schaefgen | 528/190 |
| 4,132,757 | 1/1979 | Smith et al. | 264/210.3 |
| 4,183,895 | 1/1980 | Luise | 264/345 |
| 4,184,996 | 1/1980 | Calundann | 528/190 |

FOREIGN PATENT DOCUMENTS

| | | | |
|---|---|---|---|
| 44-10492 | 5/1969 | Japan | 264/176 F |
| 45-16243 | 6/1970 | Japan | 264/184 |
| 50-87461 | 7/1975 | Japan | 8/115.5 |
| 53-147811 | 12/1978 | Japan . | |
| 54-139698 | 10/1979 | Japan . | |

*Primary Examiner*—Jay H. Woo

[57] ABSTRACT

The heat-strengthening of yarn spun from optically anisotropic melt-forming polyesters can be accelerated by coating the yarn prior to heat treatment with certain inorganic compounds.

3 Claims, No Drawings

ACCELERATION OF YARN HEAT-STRENGTHENING PROCESS

BACKGROUND OF THE INVENTION

1. Field of the Invention

This invention relates to improving the strength of yarn spun from anisotropic melt-forming polyesters.

2. Description of the Prior Art

A class of wholly aromatic polyesters that form optically anisotropic melts from which oriented filaments can be melt spun has been described in Schaefgen U.S. Pat. No. 4,118,372. Most polyesters which are disclosed in this patent are derived primarily from para-oriented dihydric phenols and para-oriented dicarboxylic acids. U.S. Pat. No. 4,083,829 discloses polyesters consisting essentially of p-oxybenzoyl moieties, 2,6-dicarbonylnaphthalene moieties and various other moieties. These are also said to exhibit anisotropy in the melt. Still other anisotropic-melt forming polyesters are disclosed in U.S. Pat. No. 4,153,779 and in many other patents and publications. These polymers are also described as liquid crystal or thermotropic polymers.

It has been taught by Luise U.S. Pat. No. 4,183,895 that yarn which has been spun from anisotropic melt-forming polyesters may be strengthened by heat treatment and this has been acknowledged in U.S. Pat. No. 4,083,829 and in other patent literature. Quite often it is found that the yarns must be heat-treated for extended periods in order to achieve significant improvement in tenacity. Applicants have found a method for accelerating the yarn heat-strengthening process.

SUMMARY OF THE INVENTION

The present invention is directed to an improvement in the process whereby yarn spun from optically anisotropic melt-forming polyesters is heated at temperatures above 250° C. for periods sufficient to increase tenacity by at least 50%. The heat-strengthening process is accelerated by coating the yarn prior to such heat-treatment with a small amount of an inorganic compound selected from the group of potassium bromide, potassium hydroxide, potassium iodide, potassium chloride, sodium chloride, sodium bromide, sodium iodide, rubidium chloride, and cesium chloride. The compounds are conveniently applied to the yarn as solutions containing as little at 0.015% by weight of compound.

DETAILED DESCRIPTION OF THE INVENTION

The yarns that are heat-treated according to this invention are composed of as-spun oriented filaments obtained by the melt-spinning of optically anisotropic melt-forming polyesters. These polyesters are conveniently aromatic polyesters of the type shown in U.S. Pat. Nos. 4,118,372, 4,083,829 and 4,181,792 and in a host of other patents and publications. The process of this invention is considered to have broad applicability to as-spun oriented polyester filaments.

The conditions of heat treatment employed are fully described in U.S. Pat. No. 4,183,895. The yarn is heated, preferably while essentially free of tension and in an inert atmosphere. Generally the atmosphere surrounding the yarn during heat-treatment is purged with nitrogen; however, vacuum may be applied for at least part of the treatment. The yarn should be maintained in a substantially relaxed condition during heat treatment. There is no advantage in holding the yarn under tension and it is generally undesirable to do so. It is often found that some shrinkage takes place during heat treatment and that the yarn will break if it is not free to contract. In addition, fusion between filaments may occur if the yarn is wrapped tightly around an unyielding bobbin.

It has been the practice to heat treat the yarn at temperatures above 250° C. in order to obtain a marked improvement in tenacity, e.g., at least 50% greater than the as-spun tenacity. The heating periods and temperatures employed will vary somewhat depending on the particular yarn polymer. To minimize fusion between filaments one would not normally exceed the flow temperature of the polymer in the yarn. It has been found that yarns of polymers with flow temperatures below about 250° C. require undesirably long periods of heat-treatment and are less preferred.

The heat strengthening accelerators used in this invention are potassium bromide, potassium hydroxide, potassium iodide, potassium chloride, sodium chloride, sodium bromide, sodium iodide, rubidium chloride, and cesium chloride. They are generally applied to the yarn from aqueous solution and in such a manner to assure uniform application to the surface of the filaments of the yarn. Solutions with as little as 0.015% by weight of the named inorganic compounds have been found to accelerate the heat-strengthening process and even smaller amounts are believed to be effective. However, more uniform results have been obtained when a solution with 0.05% or more solute has been applied, and this is preferred.

The salt may be applied to the yarn in a separate step or it may be added with other ingredients such as with a yarn finish or lubricant. The yarn may be dipped in a solution of the salt or may pick up the salt by passage over a roller in contact with the salt solution. Other techniques for application of coating are well within the skill of the art.

The degree of acceleration in heat strengthening that is obtained depends on the choice of accelerator. Thus potassium iodide and potassium chloride provide a quick response and are preferred. Other members of the selected class such as sodium chloride are effective, but give a slower response than KI or KCl. Finally a large number of inorganic compounds have been found to be totally ineffective. Withdrawal of yarn samples after increasing time intervals as in Example 4 is a particularly useful way to identify accelerator differences.

The application of accelerators diminishes the time required to reach desirable tenacity levels. This in turn reduces the investment capital needed for manufacture of such fibers. The resulting fibers are useful in fiber/-plastic composites providing strength with reduced weight compared to steel and also are useful in rubber reinforcement as in tires or belts.

TESTING PROCEDURES

Yarn tensile properties are determined on multifilament strands at 21° C. and 65% relative humidity after conditioning in that atmosphere for at least 16 hours. Samples of the yarn are broken on a standard stress-strain tester (Instron) at constant elongation rate (10%/minute). The average of at least three breaks is used to determine breaking tenacity T, breaking elongation E and initial modulus $M_i$. The yarn samples are given a twist of 3 turns per 2.54 cm (under 0.1 gpd tension) and broken with a 25.4 cm gage length.

The denier of the yarn is determined by weighing a known length (at 0.1 gpd tension); 90 cm length is convenient.

The tenacity (dN/tex), elongation (percent), and initial modulus (dN/tex) as defined in A.S.T.M. D2101, part 25, 1968 are obtained from the load-elongation curve and the measured denier. In actual practice, the measured denier of the sample, test conditions, and sample identification are fed to a computer before the start of a test. The computer records the load-elongation curve of the fiber as it is broken and then calculates the fiber properties.

EXAMPLE 1

Acceleration of Heat Strengthening by Potassium Iodide (KI)

A finish-free yarn was spun at 362° C. (melt) from an optically anisotropic melt of a copolymer comprising 95 mol % of phenyl-1,4-phenylene terephthalate and 5 mol % of 1,3-phenylene terephthalate units. The as-spun yarn consisted of 95 filaments having a total tex of about 35. The preparation of polymer of similar composition is described in Payet U.S. Pat. No. 4,159,365, Example 5. The as-spun finish-free yarn was pulled from a bobbin and passed at 27 m/min over a yarn finish applicator consisting of a pump and tubing and having a slot which applied 1 ml/min of aqueous KI solution. Several concentrations of KI were tested. The wet, coated yarn was wound on a bobbin and piddled from there into a metal basket with a Kevlar® aramid fiber web bottom to provide staggered loops of tension-free yarn. The yarn guides, pump, and parts, which provided the solution were washed between each application with distilled water to remove any potential contaminant.

Baskets of staggered loops of wet, coated yarn were heated in an oven swept with nitrogen. The oven was programmed to heat from 100° C. to 280° C. in 33 min., and from 280° C. through a maximum of 310° C. back to 280° C. in about 40 minutes. Finally, the oven was cooled to below 100° C. Table 1 gives physical properties for the yarn treated with various concentrations of KI. All the potassium iodide solutions were satisfactory for obtaining tensile strengths well above that of uncoated yarn in short exposure times. The experiment shows that high tensile properties are obtained with coated yarns at very low KI concentrations (0.015% solution) as compared with uncoated yarns provided appropriate heat treatment time and temperatures are used. Consistently improved results were not obtained at low concentrations when the heat treatment at 280° C. and above was only for 20 minutes.

EXAMPLE 2

Effect of KI Coatings on Yarns from Poly (chloro-1,4-phenylene terephthalate/2,6-naphthalate)

A 67-filament yarn of about 35-38 tex was spun from an optically anisotropic melt of a copolymer comprising 70 mol % chloro-1,4-phenylene terephthalate and 30 mol % chloro-1,4-phenylene 2,6-naphthalenedicarboxylate units similar to the copolymer described in Schaefgen U.S. Pat. No. 4,118,372, Example 7. A portion of the yarn was coated with a 1% KI aqueous solution by the process of Example 1 wherein the yarn travelling at 27 meters/min passed over a slotted finish applicator providing 1 ml/min of the candidate coating.

Samples of wet, coated yarn and uncoated yarn were heated in baskets in a nitrogen-purged oven wherein the temperature was raised from 100° C. to 265° C. in about 60 minutes, and held at 265° C. for 40 minutes, raised and held at 272° C. for 100 minutes and then cooled to below 100° C. The effect of a coating of 1.0% by weight KI aqueous solutions in water on the tenacity is shown in Table 2. KI was very effective in accelerating tenacity development in this yarn.

EXAMPLE 3

Effect of KI on Polyester Yarns Derived from Chlorohydroquinone, Terephthalic Acid and 6-Hydroxy-2-naphthoic Acid A multifilament yarn (~0.66 tex/fil) of a copolyester comprising 42.5 mol % chloro-1,4-phenylene-dioxy units, 42.5 mol % terephthaloyl units and 15 mol % 6-oxy-2-carbonyl-naphthalene units and having a finish free of alkali metal halide was heat treated in a nitrogen-purged oven with and without coating with a 1% by weight KI solution. Yarns were coated as in Example 1 and treated in baskets as before. The wet yarn was heated in an oven where the temperature increased from room temperature to 290° C. in 120 minutes, was held at 290° C. for 150 minutes, and then cooled to below 100° C. The yarn coated with 1% by weight KI had a tenacity of 25.5 dN/tex ($\sigma=0.4$) while the uncoated yarn had a tenacity of 17.4 dN/tex ($\sigma=0.5$) showing accelerated development of tenacity with KI.

EXAMPLE 4

Skeins of the yarn of Example 3 were treated at 275° C. in a glass flask which was continually purged with nitrogen while heated in a Wood's Metal Bath. A thermocouple was used to determine temperature in the treatment zone.

The effect of salt solutions on tenacity development was determined in several successive tests at 275° C. In each test a skein was first soaked in the salt solution for ½ hour and then dried at room temperature. A selected skein was then dropped into the nitrogen-purged flask and samples of the multifilament yarn were taken after 0.5, 1, 2, 3, and 5 hours at 275° C. Tensile data for the treated and untreated yarns are given in Table 3. It should be noted that two separate runs were completed for the uncoated yarn.

EXAMPLE 5

Continuous Process for Heat Strengthening

Yarns were heat treated in a continuous process in an apparatus consisting of a 3.0 m long heated tube oven of 1.9 cm inner diameter through which passed a continuous moving 2.54 cm wide glass fiber woven endless belt. The belt passed through the oven at 30 cm/min, and, after leaving the heated zone, returned to the tube entrance in a continuous loop, tracking along two 25 cm diameter driven pulleys located at the oven entrance and exit, respectively. The oven was purged with nitrogen flowing at 1.9 standard cubic feet/min (0.054 $m^3$/min). A multifilament polyester yarn of about 470 denier (52 tex) was pulled from a supply cone onto the belt by a pair of pinch rolls, one of which was the entrance pulley. The yarn passed first from the cone to a yarn guide, then through a bath containing the coating solution and then through the pinch rolls and onto the moving belt. The belt rested on the bottom of the tube, and the resulting upward concave curvature of the belt served to keep the yarn centered on the belt surface. The total exposure time in the oven was 10 minutes. The maximum temperature in one section of the oven was maintained at 335° C.±2° C. A typical temperature profile determined by use of thermocouples in the oven spaced about 30 cm apart, starting 30 cm within the oven from the entrance was 248°, 277°, 304°, 317°, 327°, 334°, 336°, 335°, and 322° C.

An as-spun yarn prepared by melt spinning a copolyester comprising 95 mol % poly(phenyl-1,4-phenylene terephthalate) and 5 mol % poly(1,3-phenylene terephthalate) was coated with 0.5% by weight aqueous potassium iodide solution. The wet yarn passed from the coating bath into the hot tube oven on the glass fiber belt and was dried and heat treated in a single operation. For comparison, a water-coated yarn and an uncoated yarn were passed through the same oven with a similar temperature profile. Properties of the heat-treated yarns are given in Table 4. The KI-treated yarn developed a much higher tenacity than water-treated yarn in the 10-minute exposure time.

EXAMPLE 6

Acceleration of Heat Strengthening By Potassium Hydroxide

A yarn of the copolymer of Example 1 was coated with potassium hydroxide from a 0.5 wt. % aqueous solution of the base by the method described in that Example. After heat treatment in a relaxed state in an oven purged with nitrogen and heated successively from room temperature to 280° C. in 42 minutes, at 280° C. to a peak temperature of 295° C. and back to 280° C. in 17 minutes and cooling to 100° C. in 1 hour, the coated yarn exhibited a tenacity of 20.5 dN/tex while control yarn (no coating) had a tenacity of 6.3 dN/tex and water coated yarn a tenacity of 8.4 dN/tex.

EXAMPLE 7

Acceleration of Heat Strengthening Rubidium and Cesium Chlorides

Two yarns of the copolymer of Example 1 were coated with rubidium chloride and with cesium chloride, respectively, from a 0.5 wt. % aqueous solution of each salt by the method described in that Example. After heat treatment in a relaxed state in an oven purged

TABLE 1

Effect of KI Concentration on Tenacity After Heat-Treatment

| % KI in Coating Solution | Tenacity, DN/Tex Average | σ |
|---|---|---|
| 0.015% KI | 19.3 | 1.1 |
| 0.025% KI | 21.3 | 0.6 |
| 0.100% KI | 22.9 | 1.0 |
| 0.5% KI | 24.1 | 0.7 |
| 1.0% KI | 21.2 | 2.1 |
| 2.0% KI | 24.4 | 1.0 |
| No coating | 7.6 | 1.2 |

TABLE 2

Acceleration of Tenacity Development for Poly(chloro-1,4-phenylene terephthalate/2,6-naphthalate)

| % KI in Coating Solution | Tenacity, DN/Tex Average | σ |
|---|---|---|
| 1% KI | 20.3 | 1.3 |
| Uncoated | 13.6 | 1.7 |

TABLE 3

Tenacity vs. Time Exposure for Yarns Coated with Several Compounds

| Time at 275° C. | Tenacity, dN/Tex Uncoated* | 1% KI | 1% KCl | 1% NaCl | 1% NaBr | 1% RbCl |
|---|---|---|---|---|---|---|
| 0 | 7.6 | | | | | |
| 10 min | — | 8.8 | | | | |
| 30 min | 6.9 | 13.0 | 9.9 | 7.1 | 7.4 | 10.0 |
| 1 hr | 8.0 | 14.2 | 14.1 | 9.5 | 9.1 | 9.7 |
| 2 hr | 10.2 | 16.2 | 15.1 | 12.7 | 14.8 | 12.9 |
| 3 hr | 12.7 | 14.5 | 18.0 | 17.2 | 14.9 | 16.7 |
| 5 hr | 14.2 | 17.8 | 17.9 | 16.2 | 17.1 | 19.2 |

*Averages from identical uncoated pairs heat-treated for the stated time.

TABLE 4

Properties of Yarn Treated in Continuous Process

| Treatment | Tenacity dN/Tex | % Elongation at Break | Initial Modulus, dN/Tex |
|---|---|---|---|
| 0.5% KI | 17.7 | 4.2 | 379 |
| Water | 7.4 | 3.1 | 283 |
| None (uncoated) | 7.5 | 3.5 | 276 |

We claim:

1. In a process for heat-strengthening yarn spun from optically anisotropic melt-forming polyesters wherein the yarn is heated at temperatures above 250° C. for a period sufficient to increase tenacity by at least 50%, the improvement comprising accelerating the heat-strengthening process by coating said yarn prior to such